US011839806B2

(12) United States Patent
Grishaj

(10) Patent No.: US 11,839,806 B2
(45) Date of Patent: Dec. 12, 2023

(54) POOL RACK

(71) Applicant: Deda Grishaj, Yonkers, NY (US)

(72) Inventor: Deda Grishaj, Yonkers, NY (US)

( * ) Notice: Subject to any disclaimer, the term of this patent is extended or adjusted under 35 U.S.C. 154(b) by 0 days.

(21) Appl. No.: 16/378,146

(22) Filed: Apr. 8, 2019

(65) Prior Publication Data

US 2020/0086202 A1 Mar. 19, 2020

Related U.S. Application Data

(60) Provisional application No. 62/733,064, filed on Sep. 18, 2018.

(51) Int. Cl.
*A63D 15/00* (2006.01)

(52) U.S. Cl.
CPC ..... *A63D 15/005* (2013.01)

(58) Field of Classification Search
CPC ..... A63B 57/13; A63D 15/005
See application file for complete search history.

(56) References Cited

U.S. PATENT DOCUMENTS 743,464 A * 11/1903 D'Abramo ..... A63D 15/005 473/40
966,552 A * 8/1910 Nhutzel ..... A63D 15/005 473/41
1,089,140 A * 3/1914 Madiean ..... A63D 15/005 473/40
1,115,911 A * 11/1914 Dickinson ..... A63D 15/005 473/40
1,116,583 A * 11/1914 Garrison ..... A63B 63/00 273/127 B
1,161,324 A * 11/1915 Matthay ..... A63B 23/16 482/44
1,660,626 A * 2/1928 Rhoads ..... A63D 15/005 473/40
1,725,494 A * 8/1929 Varnum ..... A63D 15/005 473/40
2,031,525 A * 2/1936 Clarke ..... A63B 57/40 473/180

(Continued)

FOREIGN PATENT DOCUMENTS

CN 106901504 6/2017
CN 107754303 3/2018

(Continued)

OTHER PUBLICATIONS

SIPO Office Action for Chinese Application No. 201980067338, dated Jun. 1, 2022 with English translation, 19 pages.

(Continued)

*Primary Examiner* — Melba Bumgarner
*Assistant Examiner* — Amir A Klayman
(74) *Attorney, Agent, or Firm* — Meister Seelig & Fein PLLC

(57) ABSTRACT

The present invention is directed to a pool rack for grouping pool balls tightly on a pool table. The frame has walls that may be disassembled and may move between, and exist alternatively in, an extended position that loosely group a set of billiard balls, wherein the rack walls are substantially upstanding and, or a closed position that tightly groups the balls, wherein the rack walls are angled and the frame sits atop the billiard balls.

14 Claims, 4 Drawing Sheets

(56) References Cited

U.S. PATENT DOCUMENTS 2,061,510 A * 11/1936 Drumpelmann ..... A63H 33/062 446/115
2,273,239 A * 2/1942 Weicker ..... A63D 15/005 473/40
3,236,519 A * 2/1966 Leigh ..... A63D 15/005 473/41
3,423,087 A * 1/1969 Sowa ..... A63D 15/005 473/41
3,672,671 A * 6/1972 Merola ..... A63D 15/005 473/40
3,992,005 A * 11/1976 Richey ..... A63D 15/005 16/386
4,103,773 A * 8/1978 Haber ..... A63D 15/005 206/315.9
4,338,936 A * 7/1982 Nelson ..... A61F 9/0008 604/295
4,536,995 A * 8/1985 Frederick ..... H04R 1/026 248/220.1
4,553,750 A * 11/1985 Kintz ..... A63D 15/005 473/102
4,903,965 A 2/1990 Smith
5,376,054 A * 12/1994 Kwasny ..... A63D 15/005 473/40
D367,306 S * 2/1996 Fiscella ..... D21/782
5,529,540 A * 6/1996 Rozek ..... A63D 15/005 473/40
5,601,495 A * 2/1997 Silverman ..... A63D 15/005 473/40
D390,902 S * 2/1998 Fiscella ..... D21/782
5,916,032 A * 6/1999 Stoll ..... A63D 15/005 473/40
6,261,187 B1 * 7/2001 Tsai ..... A63D 15/005 473/21
6,312,342 B1 * 11/2001 Newsome ..... A63D 15/005 473/40
6,595,862 B2 7/2003 Porper
7,166,033 B2 * 1/2007 Krajeski ..... A63D 15/005 473/40
7,192,358 B2 * 3/2007 Knupp ..... A63D 15/005 473/40
7,419,126 B2 * 9/2008 Gibson ..... F16M 13/025 248/235
7,785,209 B1 * 8/2010 Targosz, Jr. ..... A63D 15/005 473/40
8,216,078 B1 7/2012 Yovanovich et al.
8,496,535 B2 7/2013 Kaplan
8,574,089 B1 * 11/2013 Bova ..... A63D 15/005 473/40
8,911,299 B1 * 12/2014 Day ..... A63D 15/005 473/40
9,132,339 B1 9/2015 Smith
9,440,138 B1 * 9/2016 Keyes ..... A63D 15/00
2009/0029787 A1 * 1/2009 Crosbie ..... A63D 15/005 473/40
2012/0190466 A1 * 7/2012 Gardner ..... A63D 15/006 473/20
2013/0040748 A1 * 2/2013 Byrne ..... A63D 15/005 473/40
2014/0256460 A1 * 9/2014 Geiges ..... A63D 15/005 473/40
2016/0001168 A1 * 1/2016 Kincaid ..... A63D 15/005 473/40
2016/0101345 A1 * 4/2016 Ross ..... A63D 15/005 473/40
2016/0214001 A1 * 7/2016 Benson ..... A63D 15/005

FOREIGN PATENT DOCUMENTS

CN 108421246 8/2018
CN 108421246 A * 8/2018
CN 108421247 8/2018
FR 3061860 A1 * 7/2018 ..... A63D 5/08
GB 337546 11/1930
GB 337546 A * 11/1930 ..... A63D 15/005

OTHER PUBLICATIONS

Intellectual Property Office Exam Report for UK Application No. GB2103331.1, dated Mar. 1, 2022, 2 pages.

* cited by examiner

POOL RACK

CROSS REFERENCE TO RELATED APPLICATIONS

This application claims the benefit of U.S. provisional application No. 62/733,064 filed on Sep. 18, 2018 entitled "Pool Rack." The entirety of that application is hereby incorporated by reference.

STATEMENT REGARDING FEDERALLY SPONSORED RESEARCH

Not Applicable

FIELD OF INVENTION

The present invention relates generally to accessories for the game of pool and, more particularly, to a pool rack designed for use in playing a pool game.

BACKGROUND OF THE INVENTION

It is desirable when playing the game of pool or billiards to tightly rack the balls prior to a break. A tightly racked group of balls will, when broken by the impact of the cue ball, have the desirable result of a greater dispersion and separation of the object balls comprising the racked balls, spreading them more generously across the playing surface. Conventional racks, however, are not ideal for providing the optimal tight rack of balls. Such racks are oversized in that even when all of the balls are set within the rack, there is space between the balls and the rack, a necessity so that the balls can fit within the rack and the rack can be removed from the balls. The balls will often move within that space, which results in spacing between the balls and an undesirable "loose rack." Indeed, in an attempt to eliminate the space within the rack, players using conventional racks often insert their fingers inside the rack. Nevertheless, the racked balls can loosen after the player's fingers are removed or as a result of contact between the rack and the balls that occurs when removing the rack. The above-described deficiencies of today's systems are merely intended to provide an overview of some of the problems of conventional systems and are not intended to be exhaustive. Other problems with the state of the art and corresponding benefits of some of the various non-limiting embodiments may become further apparent upon review of the following detailed description.

In view of the foregoing, it is desirable to provide improved devices and methods for racking billiard balls.

BRIEF DESCRIPTION OF THE DRAWINGS

The accompanying drawing figures incorporated in and forming a part of this specification illustrate several aspects of the invention and together with the description serve to explain the principles of the invention.

SUMMARY OF THE INVENTION

Figure 1:
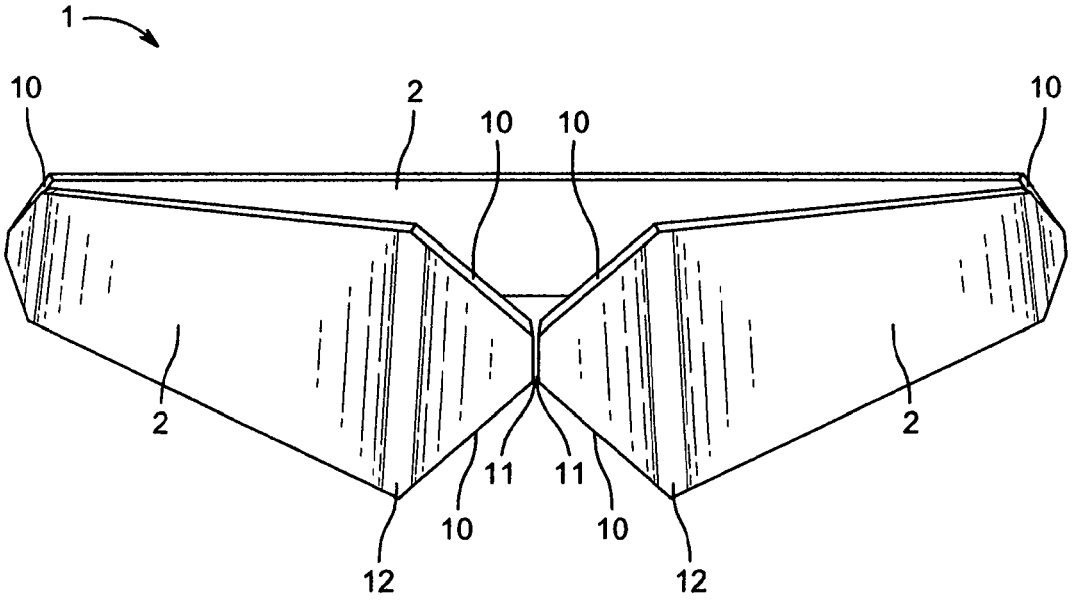
FIG. 1 is a depiction of another embodiment of a rack when extended.

The following presents a brief summary of the innovation in order to provide a basic understanding of the aspects of the innovation. This summary is not an extended overview and is not intended to cover each and every element of the innovation or to limit its scope. A more detailed description is presented later.

In one embodiment, the present invention provides a pool rack for grouping pool balls tightly on a pool table comprising a plurality of rack walls each having two ends of a connection at the surfaces that can physically come into contact with the other rack walls, the two ends of a connection can allow the whole rack to be adapted into a shape so that at a first connected end the rack walls form a substantially triangular shape in a upstanding position that loosely group a set of billiard balls that can be known as the upstanding extended frame, and when the rack walls are connected to each other at a second connected end the rack walls form a substantially triangular shape with angled rack walls that sits atop the set of billiard balls and tightly groups the set of billiard balls that can be known as the angled closed frame, said pool rack also including a connecting means located at each of the two ends of a connection at the surface that can physically come into contact with the other rack walls, where it can be understood as a vertex of the triangle that connects the rack walls; alternatively, at the first connected end wherein the rack walls form the triangular shaped upstanding extended frame and the second connected end wherein the rack walls form the triangular shaped angled closed frame, said connecting means permitthg manual movement of the rack wall connection between the first connected end and second connected end, or from the upstanding extended frame to the angled closed frame.

In another embodiment, the invention comprises a pool rack for grouping pool balls tightly on a pool table comprising a plurality of rack walls each including two ends, said first end and second end being adapted in shape so that when the rack walls are connected to each other at a first connected end the rack walls form a substantially diamond shape upstanding rack position that loosely group a set of billiard balls, and when the rack walls are connected to each other at a second connected end the rack walls form a substantially diamond shape angled rack position that sits atop the set of billiard balls and tightly groups the set of billiard balls, and a connecting means located at each of the two ends of a connection at the surface that can physically come into contact with the other rack walls, where it can be understood as a vertex of the diamond formed that connects the rack walls alternatively at the first connected end wherein the rack walls form the diamond shaped upstanding extended frame and the second connected end wherein the rack walls form the diamond shaped angled closed frame, said connecting means permitting manual movement of the rack wall connection between the first connected end and second connected end.

In yet another embodiment, the invention comprises a pool rack for grouping pool balls tightly on a pool table comprising three rack walls, each having two ends, said first end and second end being adapted in shape so that when the rack walls are connected to each other at a first connected end the rack walls form a substantially triangular shaped upstanding rack position that loosely group a set of billiard balls, and when the rack walls are connected to each other at a second connected end the rack walls form a substantially triangular shape at at angled position that sits atop the set of billiard balls and tightly groups the set of billiard balls, and a first connecting means located at each of the two ends of a connection at the surface that can physically come into contact with the other rack walls, where it can be understood as a vertex of the triangle formed by the connected rack walls at the first connected end so that the rack forms the triangular shaped upstanding extended frame, said first connecting means also allowing the rack walls to be disconnected from each other at the first connected end and manually transformed so that the rack walls are connected at the second connected end to form the triangular shaped closed frame, and a second connecting means located at each vertex of the triangle formed by the connected rack walls for connecting the rack walls at the second connected end so that the rack forms the triangular shaped closed frame, said second connecting means also allowing the rack walls to be disconnected from each other at the second connected position and manually transformed so that the rack walls are connected at the first connected end to form the triangular shaped extended frame.

In another aspect of the invention, the connecting means are selected from the group consisting of magnets and magnetic material.

In another aspect of the invention, the rack walls include a flexible portion to allow bending of the terminal ends of the rack walls.

In another aspect of the invention, two ends of the rack walls are tapered.

In another aspect of the invention, two ends of the rack walls are rounded.

Particular illustrations are described in connection with the following descriptions and the annexed drawings. These illustrations are indicative, however, of but a few of the various ways in which the principles of the innovation can be employed. Other advantages will be readily apparent from the detailed description that follows. The subject innovation is intended to include all aspects and equivalents.

DETAILED DESCRIPTION OF THE INVENTION

The present invention can be better understood from the following description of preferred embodiments, taken in conjunction with the accompanying drawings. It should be apparent to those skilled in the art that the described embodiments of the present invention provided herein are merely exemplary and illustrative and not limiting.

The present invention is directed to a novel and non-obvious devices and methods for racking balls for a game of pool or billiards. The invention is an improved rack for tightly racking billiard or pool balls. The rack of the present invention can exist alternatively in an extended or closed state and in one preferred embodiment includes tapered walls. Certain specific details are set forth in the following description and figures to provide a thorough understanding of various embodiments of the invention. Those of ordinary skill in the relevant art will understand, however, that the invention may have additional embodiments which may be practiced without several of the details described below. In other instances, those of ordinary skill in the relevant art will appreciate that the devices and methods described can include additional details without departing from the spirit or scope of the disclosed embodiments.

In a traditional pool rack, the walls of the rack frame are fixed to one another. In other words, the rack walls cannot move in relation to one another and are not capable of disconnecting from each other. In the invention, the rack walls can move in relation to each other which allows the rack to exist in either an angled closed position or an upstanding extended position. When extended, the rack is big enough to place billiard balls inside. When closed, the rack encloses a group of billiard balls and ensures a tight squeeze over the billiard balls, keeping them in place. While the figures set forth here depict a triangular rack designed to rack a set of fifteen billiard balls, the concepts set forth in this application can be applied equally to smaller racks or racks of different shapes. For example, a game of "nine ball" uses nine billiard balls and a diamond shaped rack rather than fifteen balls and a triangular shaped rack. Moreover, in certain embodiments, the walls of the rack can be completely disconnected from each other. These features eliminate the aforementioned shortcomings associated with a fixed wall racks.

Figure 2:
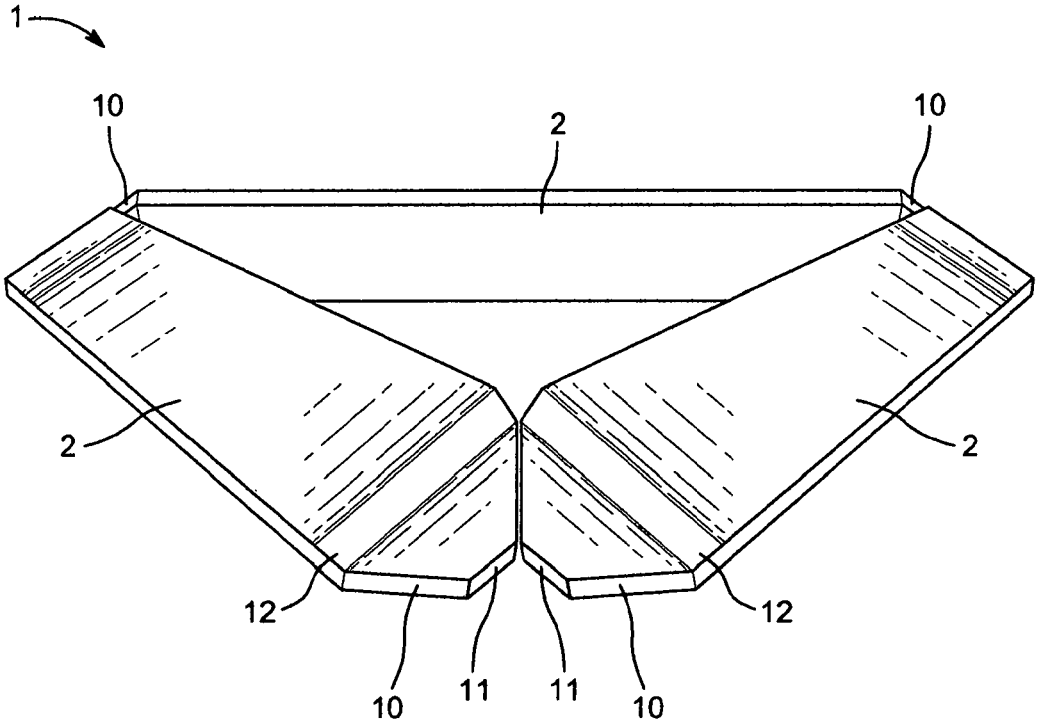
FIG. 2 is a depiction of the rack depicted in FIG. 1 when closed.
Figure 3:
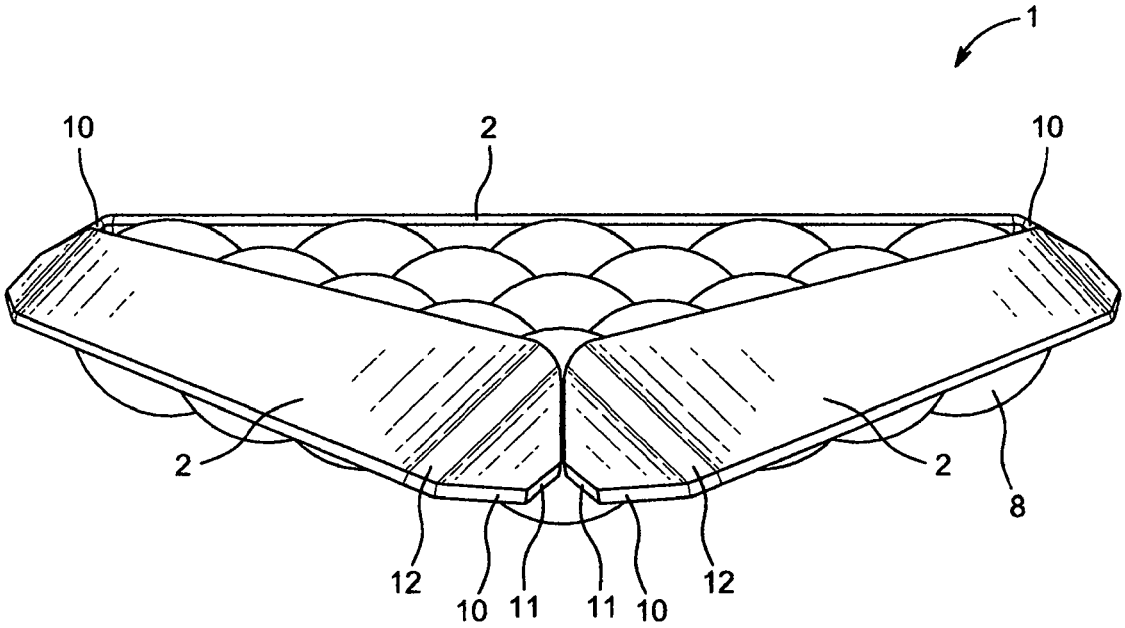
FIG. 3 is a perspective view of an alternate embodiment of a closed rack with billiard balls shown for reference in the rack.

Referring now to the drawings and in particular to FIGS. 1-4, of which FIGS. 2 and 3 presents the rack 1 for use in tightly positioning or "racking" a set of billiard balls or the like. FIG. 2 is a front view of one embodiment of a closed rack showing the rack walls 2 connected into a substantially triangular to receive a rack wall 2.

FIG. 1 depicts one embodiment of a rack 1 in the upstanding extended position. The rack 1 in FIG. 1 comprises three rack walls 2 which are substantially identical connected to each other connected in a substantially triangular shape and in a manner that allows the rack 1 to move between the angled closed position depicted in FIGS. 2 and 3 and an upstanding extended position depicted in this FIGS. 1 and 4. The rack walls 2 may be hollowed to decrease the weight of the rack 1, although hollowing is not required, especially if the rack walls 2 are made of some lightweight material. In the embodiment shown in FIG. 1, the ability to move between the angled closed and upstanding extended positions is facilitated by connecting means 13.

A connecting means will allow transformation of the walls 2 between the angled closed and upstanding extended positions but also will allow full disassembly of the rack, when the rack 1 is not in use.

FIGS. 1-4 depict an embodiment of the rack 1 wherein the ability to move between the angled closed and upstanding extended positions is facilitated by the shape of the rack walls and the connecting means for connecting the rack walls to one another. The exact shape of the end of the rack wall is not critical so long as the shape permits movement between the upstanding extended position and the angled closed position.

Figure 4:
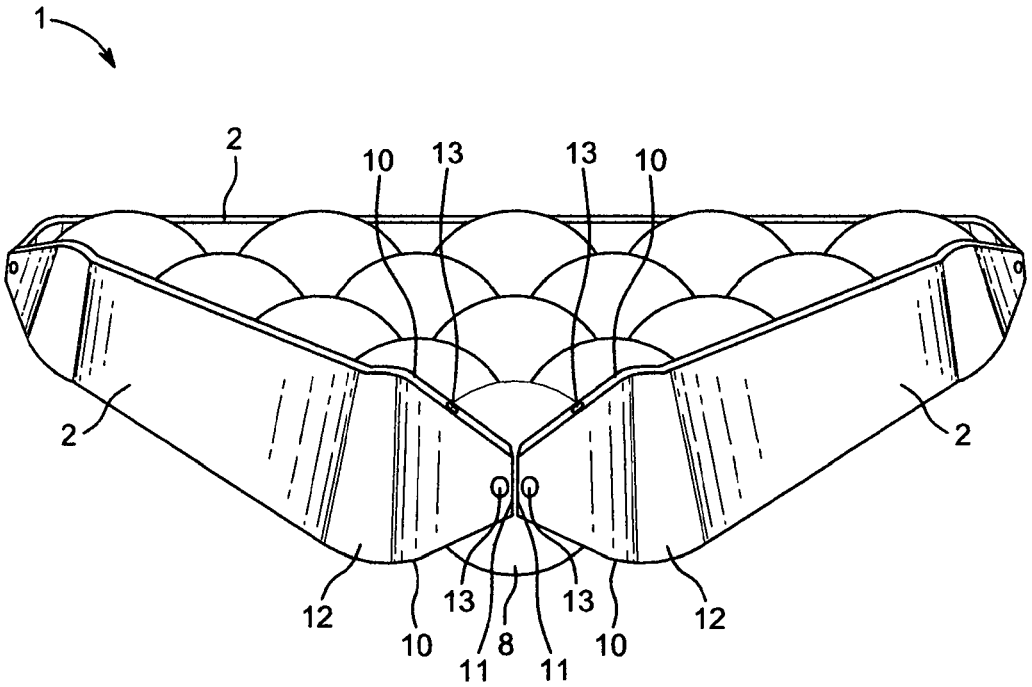
FIG. 4 is perspective view of a rack when fully extended with billiard balls shown for reference in the rack.

FIG. 1 shows the rack walls 2 connected into a substantially triangular shape. Each of the rack walls 2 of the FIG. 1 embodiment includes an upstanding wall 11 and four tapered edges 10, on the upper portion of each end of the rack wall 2 and on the lower portion of each end of the rack wall 2. It should be noted that the use of tapered edges 10 on both the upper and lower portion of each side of rack wall allows bidirectionality of the rack walls 2, however four tapered edges are not required so long as functionality is retained. Those of skill in the art will recognize that myriad shapes of the ends of the rack walls may perform the function of achieving a rack that can be moved from an upstanding extended to an angled closed position as described herein. Turning back to FIG. 1, the rack walls 2 are connected to each other at a first connected end at the upstanding wall 11 and form an upstanding extended rack. FIG. 1 also shows an optional flexible portion 12 that is useful in permitting proper fitting and transformation of the rack 1. Such flexible portion 12 may be made of any material that provides sufficient flexibility to permit the rack walls 2 to connect to each other in the manner and with the result as described herein. FIG. 4 depicts an embodiment that is similar to the rack 1 of FIG. 1 in the upstanding extended position loosely grouping the billiard balls 8, shown for reference. The embodiment in FIG. 4 also shows connecting means such as magnets 13 located on the upper tapered edge 10 of each rack wall 2 and at the upstanding wall 11.

FIG. 2 shows the rack walls 2 of the embodiment show in FIG. 1 connected into a substantially triangular angled closed shape. Like the embodiment in FIG. 1, the FIG. 2 embodiment includes an upstanding wall 11 and four tapered edges 10, on the upper portion of each end of the rack wall 2 and on the lower portion of each end of the rack wall 2, and a flexible portion 12. As shown in FIG. 2, the rack walls 2 are connected to each other at a second connected end at the upper tapered edge 10 which creates an angled closed rack. FIG. 3 depicts the rack 1 of FIG. 2 seated atop and tightly grouping the billiard balls 8, shown for reference.

Taking the embodiments depicted in FIGS. 1-4 together, the rack walls 2 are shaped so that each end of each rack wall 2 includes a tapered edge 10 and an upstanding wall 11. The rack walls 2 may be connected at a first connected end located on or at the upstanding wall 11 or at a second connected end located on or at the upper tapered edge 10. In other embodiments, there may be a third connected end on the lower tapered edge. When connected at the first connected end as shown in FIGS. 1 and 4, the rack walls 2 will form a substantially triangular shape wherein the rack walls 2 are upstanding and loosely group a set of billiard balls. When connected at the second connected end as shown in FIGS. 2 and 3, the rack walls 2 will form a substantially triangular shaped closed frame wherein the rack walls 2 are angled and the frame sits atop the set of billiard balls 8 and tightly groups the set of billiard balls 8. When the rack 1 is in the angled closed position, the rack walls 2 are angled at approximately 48 degrees in relation to the pool table, although this angle may vary.

The rack 1 in such embodiments include one or more connecting means that permit movement from the first connected end to the second connected end and back to the first connected position for connecting the rack walls 2 at each end where the rack walls 2 are connected to each other. It should be noted that while it is advantageous in some instances to have identical rack walls 2, a connecting means need not be present at the end of each rack wall 2. In an embodiment with a single connecting means at each 10, 11 end of the rack wall 2, the connecting means permits movement from the first connected end to the second connected end. In yet another embodiment, the connecting means permits movement between the first connected end, the second connected end and a third connected end through use of a single or multiple connecting means. In another embodiment with two connecting means at each 10, 11 end of the rack wall 2, one is preferably located at or on the upstanding wall 11 and another preferably located at or on the tapered edge 10. In yet another embodiment, the end of the rack wall 2 may be tapered on both the top and bottom edges and the rack wall 2 may have a connector at or on the upstanding wall 11 and at or on each tapered edge 10, forming a rack wall 2 that is bidirectional.

The connecting means may be, for example, magnets or magnetic material, Velcro®, buckles, adhesive material, tapes, clips, clasps, snap, hook, pins, or straps or some other mechanical connector. In one example, the connecting means may be a single magnet or magnetic material at the ends of the rack walls 2 at the first connected end and the second connected end and allows the rack walls 2 to be connected at the first connected end or at the second connected end. Alternatively, there may be separate magnets, one at each connecting end. In still another embodiment, the magnets are of such strength that they permit the rack walls 2 to be separated slightly and form the extended position. Those of skill in the art will be able to easily ascertain appropriate magnet strength to provide the desired results. In a preferred embodiment, the connecting means also allows the rack walls 2 to be wholly disconnected from one another. This disassembly allows more convenient storing and transporting of the rack walls 2 as they would not be configured into a space consuming triangular frame. Further to the ease of transportation and the versatility of the rack 1, the rack walls 2 in theory may be telescoping, or may be made up of multiple sections that could be disconnected from one another, so that the rack walls 2, or pieces thereof, may be made even smaller, which will ease transportation and will also permit use of the rack in games where less than fifteen billiard balls are used.

Billiard balls 8, while not a part of the invention, are used herein for descriptive purposes and to add context to the description of the invention. Billiard ball should be taken to mean a standard billiard ball or the like such as are widely commercially available and are commonly used in playing games of billiards and pool.

Moreover, as shown by the embodiment depicted in FIG. 2, the walls 2 of the rack 1 may be angled such that the top end of wall 2 angles inward towards the center of rack 1. The angled walls facilitate the removal of the rack 1 from racked balls 8 without disturbing or moving racked balls 8 due to a collision of rack balls 8 by one or more of walls 2. The walls need not be angled when the rack is in the upstanding extended position, however. As depicted in FIGS. 1 and 4, which show one embodiment of the rack in the extended position, the walls may be substantially upright in the upstanding extended position but may become angled when the rack is transformed into the angled closed position as shown in FIGS. 2 and 3. Those skilled in the art will recognize that the exact angle is not critical and the invention may encompass frame walls 2 with angles of other degrees that accomplish the same result. It is noted that the rack walls 2 may be constructed of any suitable material, including, but not limited to, wood, plastic, metals or any other suitable material.

In practice, the assembled extended rack 1 is placed around a group of billiard balls 8 that are resting on a playing surface as shown in FIG. 4. Alternatively, the rack 1 assembled and in the upstanding extended position can be placed on the playing surface and the billiard balls 8 placed within the extended rack. In an alternate embodiment which relies on the shape of the end of the rack walls, the racks walls 2 are moved in relation to each other to manually transform the rack 1 from the upstanding extended position to the angled closed position. Moving the rack 1 into the angled closed position causes the rack 1 to push itself over the billiard balls 8 and tighten them together and causing the rack 1 to sit on top of the billiard balls as shown in FIG. 3. When closed over the billiard balls 8, the rack 1 will be touching the billiard balls 8, but not the playing surface as shown in FIG. 3. This provides another advantage of this configuration and of the invention in that it leaves the bottom open for moving and fixing the billiard balls 8. The billiard balls 8 with rack 1 may then be positioned as needed on the playing surface, the billiard balls fixed and the rack 1 removed. The angled walls 2, as opposed to straight vertical walls present in traditional pool racks, ease the removal of rack 1 without disturbing billiard balls 8 and the likelihood of a tightly racked set of billiard balls 8 is substantially increased.

Although the invention has been described in connection with specific preferred embodiments and certain working examples, it should be understood that the invention as claimed should not be unduly limited to such specific embodiments. With respect to the above description, it is to be realized that the optimum dimensional relationship for the various components of the rack 1, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the rack 1. Various modifications and variations of the described methods and systems of the invention will be apparent to those skilled in the art without departing from the scope and spirit of the invention.

I claim:

1. A pool rack for grouping pool balls tightly on a pool table comprising:

(a) three separable rack walls, each rack wall including a body portion extending between a first end and a second end, the body portion including a bottom edge and a top edge, wherein:

each of the first and second ends includes a distal wall and an upper tapered edge extending from the distal wall to the top edge of the body portion;

when first, second and third rack walls of the three separable rack walls are configured in a first orientation:

the distal wall of the first end of the first rack wall is configured to directly engage against the distal wall of the second end of the second rack wall;

the distal wall of the first end of the second rack wall is configured to directly engage against the distal wall of the second end of the third rack wall; and the distal wall of the first end of the third rack wall is configured to directly engage against the distal wall of the second end of the first rack wall;

when the first, second and third rack walls of the three separable rack walls are configured in a second orientation:

the upper tapered edge of the first end of the first rack wall is configured to directly engage against the upper tapered edge of the second end of the second rack;

the upper tapered edge of the first end of the second rack wall is configured to directly engage against the upper tapered edge of the second end of the third rack wall; and the upper tapered edge of the first end of the third rack wall is configured to directly engage against the upper tapered edge of the second end of the first rack wall;

bottom edges of the body portions of the rack walls are configured to rest on a pool table surface in conjunction with placement of the rack walls around a loosely grouped set of billiard balls in the first orientation; and the bottom edges of the rack walls are configured to be spaced apart from the pool table surface in conjunction with placement of the rack walls around the set of billiard balls in a tight positioning in the second orientation; and (b) a connecting means located at each of the first and second ends of the rack walls, the connecting means being configured to:

when the first, second and third rack walls of the three separable rack walls are configured in a first orientation:

removably couple the distal wall of the first end of the first rack wall and the distal wall of the second end of the second rack wall together;

removably couple the distal wall of the first end of the second rack wall and the distal wall of the second end of the third rack wall together; and removably couple the distal wall of the first end of the third rack wall and the distal wall of the second end of the first rack wall together; and when the first, second and third rack walls of the three separable rack walls are configured in a second orientation:

removably couple the upper tapered edge of the first end of the first rack wall and the upper tapered edge of the second end of the second rack wall together;

removably couple the upper tapered edge of the first end of the second rack wall and the upper tapered edge of the second end of the third rack wall together; and removably couple the upper tapered edge of the first end of the third rack wall and the upper tapered edge of the second end of the first rack wall together.

2. The pool rack of claim 1, where the connecting means allows the first and second rack walls to be disconnected from each other.

3. The pool rack of claim 2, where the connecting means is selected from the group consisting of magnets and magnetic material.

4. The pool rack of claim 3, wherein each of the distal walls and the upper tapered edges comprises a corresponding magnet or magnetic material.

5. The pool rack of claim 1, wherein the distal wall of the first end of the first rack wall and the distal wall of the second end of the second rack wall are spaced apart when the first and second rack walls are configured in the second orientation.

6. The pool rack of claim 1, wherein the upper tapered edge of the first end of the first rack wall and the upper tapered edge of the second end of the second rack wall are spaced apart when the first and second rack walls are configured in the first orientation.

7. The pool rack of claim 1, wherein the second orientation comprises the first, second and third rack walls being configured in a substantially triangular shape.

8. The pool rack of claim 1, wherein the second orientation comprises the body portions of the first, second and third rack walls each being configured at an angle of about 48 degrees to the pool table surface.

9. A pool rack for grouping pool balls tightly on a pool table comprising:

three separable rack walls, each rack wall including a body portion extending between a first end and a second end, the body portion including a bottom edge and a top edge, wherein:

each of the first and second ends includes a distal wall and an upper tapered edge extending from the distal wall to the top edge of the body portion;

when first, second and third rack walls of the three separable rack walls are configured in a first orientation, the distal walls of adjacent rack walls are configured to directly engage against each other;

when the first, second and third rack walls of the three separable rack walls are configured in a second orientation, the upper tapered edges of the adjacent rack walls are configured to directly engage against each other;

bottom edges of the body portions of the rack walls are configured to rest on a pool table surface in conjunction with placement of the rack walls around a loosely grouped set of billiard balls in the first orientation; and the bottom edges of the body portions are configured to be spaced apart from the pool table surface in conjunction with placement of the rack walls around the set of billiard balls in a tight positioning in the second orientation; and at least one magnet or magnetic material located at each of the first and second ends of the rack walls, the at least one magnet or magnetic material being configured to:

when the first, second and third rack walls of the three separable rack walls are configured in the first orientation, removably couple the distal walls of the adjacent rack walls together; and when the first, second and third rack walls of the three separable rack walls are configured in the second orientation, removably couple the upper tapered edge of the adjacent rack walls together.

10. The pool rack of claim 9, wherein each of the distal walls and the upper tapered edges comprises a corresponding magnet.

11. The pool rack of claim 9, wherein the second orientation comprises the first, second and third rack walls being configured in a substantially triangular shape.

12. The pool rack of claim 9, wherein the second orientation comprises the body portions of the first, second and third rack walls each being configured at an angle of about 48 degrees to the pool table surface.

13. The pool rack of claim 9, wherein the distal walls of the adjacent rack walls are spaced apart when the adjacent rack walls are configured in the second orientation.

14. The pool rack of claim 9, wherein the upper tapered edges of adjacent rack walls are spaced apart when the adjacent rack walls are configured in the first orientation.

* * * * *